US005617464A

United States Patent [19]

Mika et al.

[11] Patent Number: 5,617,464

[45] Date of Patent: Apr. 1, 1997

[54] CATHODE SYSTEM FOR AN X-RAY TUBE

[75] Inventors: Norbert Mika, Buckenhof; Hannjoerg Bittorf, Erlangen, both of Germany

[73] Assignee: Siemens Aktiengesellschaft, Munich, Germany

[21] Appl. No.: 520,412

[22] Filed: Aug. 29, 1995

[30] Foreign Application Priority Data

Aug. 29, 1994 [DE] Germany ..... 44 30 622.9

[51] Int. Cl.[6] ..... H01J 35/30

[52] U.S. Cl. ..... 378/137; 378/138; 315/169.1

[58] Field of Search ..... 378/121, 137, 378/138, 101, 106, 108, 109, 110, 111, 112, 113, 114, 115, 145; 315/169.1–196.3; 313/156, 443, 153, 237; 250/423 F

[56] References Cited

U.S. PATENT DOCUMENTS 4,798,957 1/1989 Tolner ..... 313/237

5,077,771 12/1991 Skillicorn et al. ..... 378/136

FOREIGN PATENT DOCUMENTS 2437119 2/1976 Germany ..... 378/138

3228816 2/1984 Germany .

3514700 10/1985 Germany .

3426623 10/1987 Germany .

*Primary Examiner*—Don Wong

*Attorney, Agent, or Firm*—Hill, Steadman & Simpson

[57] ABSTRACT

A cathode system for an x-ray tube has an electron emitter and a further electrode arranged between electron emitter and the x-ray tube anode. This further electrode can be connected to a potential deviating from the potential of the electron emitter with a switching stage having a pulse-pause (on-off) ratio set to produce the desired average tube current.

11 Claims, 2 Drawing Sheets

CATHODE SYSTEM FOR AN X-RAY TUBE

BACKGROUND OF THE INVENTION

1. Field of the Invention

The present invention is directed to a cathode system for an x-ray tube of the type having an electron emitter and a further electrode arranged between electron emitter and anode.

2. Description of the Prior Art

Cathode systems currently utilized in x-ray tubes have reached the limits of their development with respect to service life and focus shape. A longer service life and what is referred to as a "Gaussian" focus occupation, however, will be desired in future. Gaussian focus occupation means that the intensity of the electrons incident onto the x-ray tube anode, and thus the intensity of the X-radiation emanating from the focus, are maximum in the center of the focus and decrease toward the edge, analogously to a Gaussian bell curve.

A cathode system of the initially cited type is generally known from the work of Pierce in the form of an electrode system which at least partially meets these demands. The further electrode of the known electrode system is an auxiliary anode that is shaped such that the influences of the space charges of the electron beam are compensated. A disadvantage of this system is that the voltages at the anode, the auxiliary anode and the electron current (tube current) are linked to one another. The tube current, thus, is no longer freely selectable; this means that, for example, a specific tube current is associated with a specific tube voltage. Theoretically, it would be conceivable to alleviate this disadvantage by introducing a further, cathode-proximate control grid. This however, could only be technologically realized in a very complicated way.

X-ray tubes having a cathode system of the type initially cited are disclosed in German OS 34 26 623 and German OS 35 14 700.

Further, German OS 32 28 816 discloses a method for x-ray computed tomography wherein keyed x-ray pulses that are generated by keying the electron current in the x-ray tube with a Wehnelt cylinder, are employed for achieving an improved signal-to-noise ratio without increasing the radiation dose.

SUMMARY OF THE INVENTION

An object of the present invention is to provide an electron emission system in the form of a cathode system of the type initially cited but wherein the anode current is freely selectable—at least within certain limits—independently of the voltages at the anode and at the further electrode and in a simple way.

This object is inventively achieved in a cathode system for an x-ray tube that has an electron emitter and a further electrode arranged between the electron emitter and the anode and, by means of a switching stage having a pulse-pause (on-off) ratio set to produce the desired tube current, the further electrode can be switched to a potential that deviates from the potential of the electron emitter. There is thus no direct linkage of the tube current with the potentials of the anode and the further electrode. On the contrary, the tube current can be selected independently of these quantities by setting the pulse-pause ratio.

The pulse-pause ratio is adjustable according to a preferred embodiment of the invention; different tube currents can thus be set independently of the potentials of the anode and the further electrode.

According to further versions of the invention, the further electrode may be formed by a Wehnelt electrode and/or an auxiliary anode, whereby the Wehnelt electrode can be switched to a negative potential and the auxiliary anode can be switched to a positive potential with the switching stage.

The auxiliary anode (if used) can have an opening extending therethrough for passage of the electron beam emanating from the electron emitter. In this case, in a preferred embodiment of the invention, the extent of the auxiliary anode in the direction of the electron beam propagation is at least equal to the smallest clearance of the through-opening. Given an elliptical through-opening, the extent of the auxiliary anode would thus be at least equal to the minor axis of the through opening. Good decoupling of the anode potential from the electron emitter is achieved with this measure.

In a further embodiment of the invention the duration of a switching cycle of the switching stage does not significantly exceed 10 μs. This results in the individual pulses not being noticeable, and it is effectively the average or medium current which interacts with the rotating anode and the imaging system used with the x-ray tube (for example, an x-ray image intensifier/video chain).

A good range of adjustment of the tube current can be achieved when the potential available for connection to the further electrode be connected is on the order of magnitude of from 5 through 20 kV.

A further object of fashioning an x-ray tube wherein the tube current is freely selectable in a simple way and independently of the potentials at the further electrode and at the anode is inventively achieved in an x-ray tube having an anode and a cathode system as described above.

DESCRIPTION OF THE PREFERRED EMBODIMENTS

Figure 1:
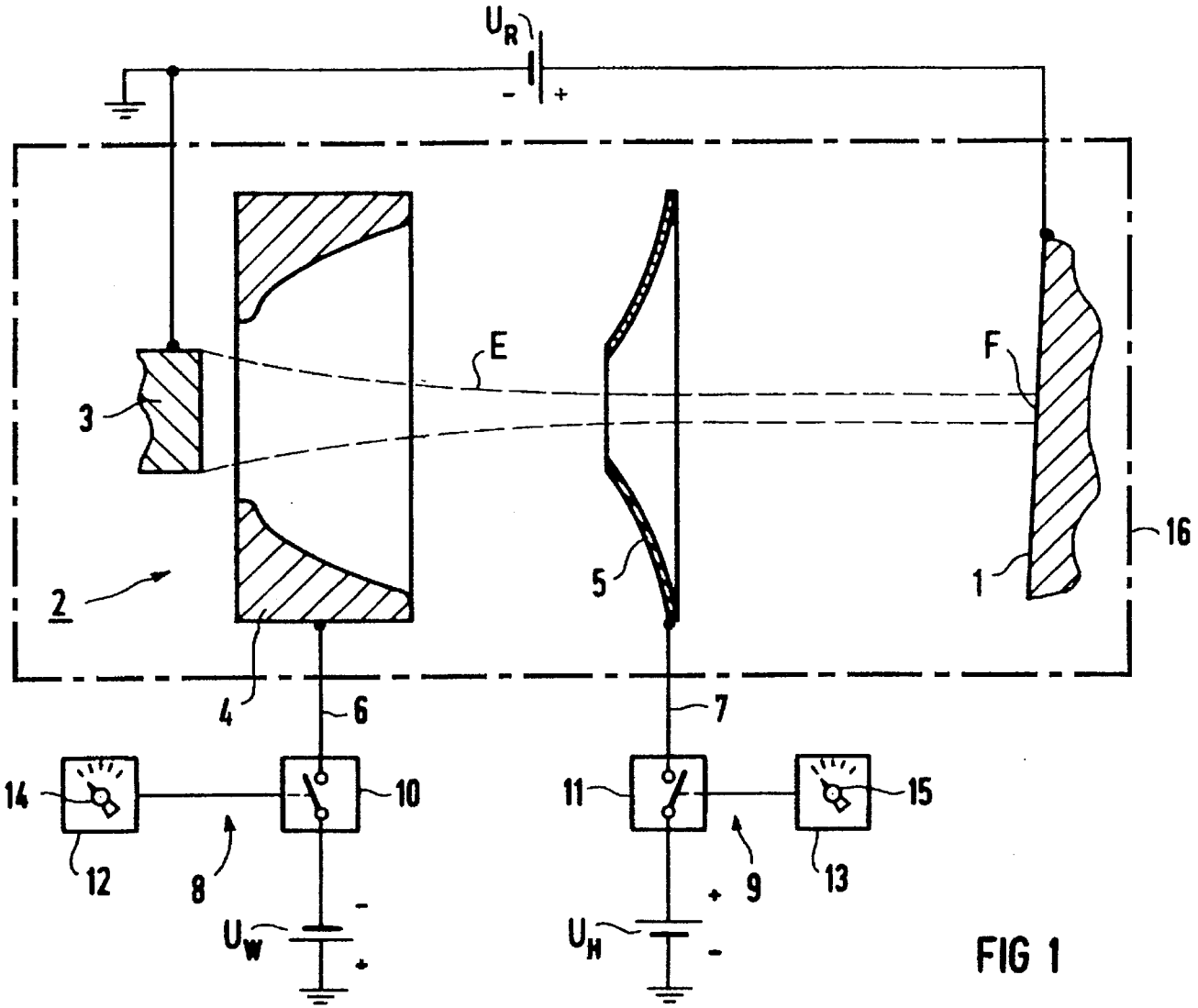
FIG. 1 is a schematic illustration of the basic components of an x-ray tube containing an inventive cathode system.

FIG. 1 shows an anode 1 and a cathode system (generally referenced 2) of an x-ray tube, in section. The x-ray tube has an evacuated housing 16, schematically indicated by a dot-dash line. Other components of the x-ray tube not shown in FIG. 1 are conventionally constructed. The anode 1, of which only a small region is shown, can be a known rotating or fixed anode and is formed of material which emits x-rays when struck by high-energy electrons.

The cathode system 2 contains a schematically illustrated electron emitter 3 that, for example, can be a directly or indirectly heated thermionic cathode. A tube voltage $U_R$ is across the electron emitter 3 and the anode 1 as schematically indicated in FIG. 1. When the electron emitter 3 is active, an electron beam E, indicated with broken lines in FIG. 1, emanates therefrom and strikes the anode 1. X-radiation is emitted from the point of incidence of the electron beam E on the anode, referred to as the focus F of the x-ray tube.

Two further electrodes are provided in addition to the electron emitter 3 and the anode 1, namely a Wehnelt electrode 4 fashioned approximately tulip-shaped and an auxiliary anode 5 which is curved and saucer-like, each of which has a through-opening for the electron beam E. Via respective lines 6 and 7, the Wehnelt electrode 4 and the auxiliary anode 5 are connected respectively to a negative potential $-U_W$ and to a positive potential $+U_H$—each measured with reference to the potential of the electron emitter 3—and each on the order of magnitude of 5 through 20 kV.

Switching stages 8 and 9 overall are respectively connected into the lines 6 and 7. Preferably each of the switching stages 8 and 9 includes an electronic switch (10 or 11) and a clock generator (12 or 13) connected thereto. The clock generators 12 and 13 each supply a clock signal that controls the corresponding switch 10 or 12 such that the Wehnelt electrode 4 or the auxiliary anode 5, respectively, is alternatingly connected to and disconnected from the potential $-U_W$, or $+U_H$. The clock generators 12 and 13 are fashioned such that the pulse-pause ratio of the respectively generated clock signal is adjustable. Such adjustment is indicated in FIG. 1 by regulators 14 and 15.

It is thus possible to select or set the average tube current flowing during operation of the x-ray tube independently of the potentials at which the anode 1, the Wehnelt electrode 4 and the auxiliary anode 5 lie, by means of the pulse-pause ratios of the switching stages 8 and 9.

The tube voltage $U_R$ and the potentials $U_H$ and $U_W$ thus only influence the tube current insofar as they establish the limits within which the average tube current can be varied by varying the pulse-pause ratios of the switching stages 8 and 9. A linkage of the tube current with, for example, the tube voltage $U_B$ in the sense that a specific tube current arises for a specific tube voltage does not exist. Instead, within the aforementioned limits, different tube currents can be set for the same tube voltage, or the same tube current can be realized given different tube voltages.

In order to avoid interference due to the switching events of the switching stages 8 and 9, it is expedient for the duration of a switching cycle (pulse duration plus pause duration) not to significantly exceed 10 μs.

Figure 2:
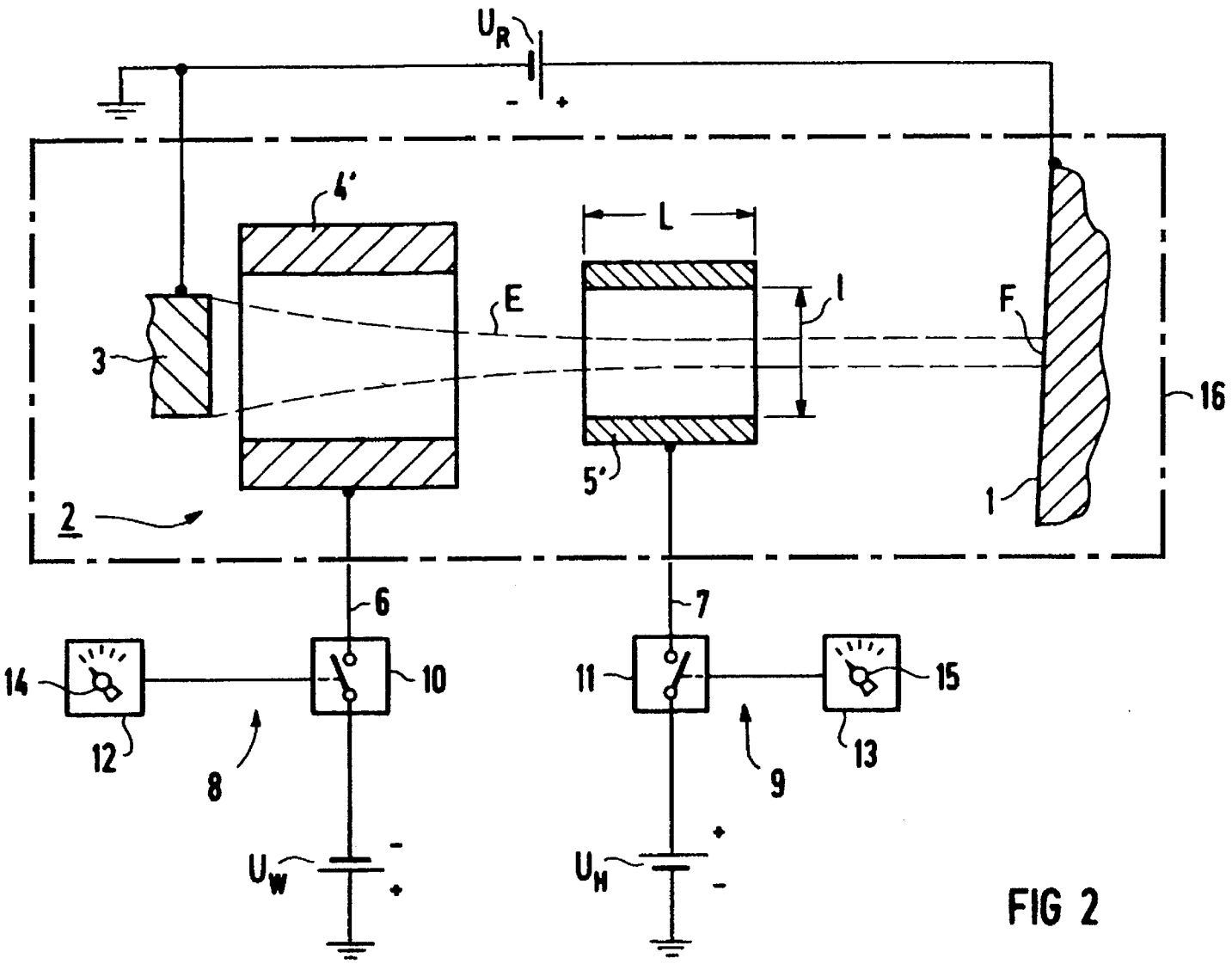
FIG. 2 shows a modification of the invention in an illustration analogous to FIG. 1.

The exemplary embodiment according to FIG. 2 differs from that set forth above in that the Wehnelt electrode 4' and the auxiliary anode 5' are each tubularly fashioned. In the case of the auxiliary anode 5', the length L measured in the direction of propagation of the electron beam E is larger than the clearance l of the through-opening, for achieving good decoupling of the anode potential from the electron emitter 3. The length L should be at least equal to the clearance l in order to achieve good decoupling. In case of an auxiliary anode 5' that is not dynamically balanced, or given a cross-section of the through-opening that is not constant over the length L of the auxiliary anode 5', the smallest clearance thereof is the determining factor.

Two further electrodes, namely the Wehnelt electrode 4 or 4' and the auxiliary anode 5 or 5', are present in the exemplary embodiments that have been set forth. The further electrodes can be respectively connected to a potential $U_W$ or $U_H$ deviating from the potential of the electron emitter with a switching stage 8 or 9 having a pulse-pause ratio corresponding to a desired tube current. It is also within the scope of the invention, however, to provide the possibility of connecting only one of these two further electrodes to a potential deviating from the potential of the electron emitter with a switching stage in the way set forth. There is also the possibility of providing only a single further electrode that, of course, must then be provided with a switching stage in the way set forth.

In the exemplary embodiments that have been described, the pulse-pause ratio of the switching stage is adjustable in order to be able to adjust the tube current. If an adjustability of the tube current is not desired, the pulse-pause ratio of the switching stage is permanently set according to the desired tube current.

Although modifications and changes may be suggested by those skilled in the art, it is the intention of the inventors to embody within the patent warranted hereon all changes and modifications as reasonably and properly come within the scope of their contribution to the art.

We claim as our invention:

1. An electron emission system comprising:

an electron emitter which emits an electron beam in a propagation direction;

an anode;

an auxiliary anode disposed between said electron emitter and said anode, said auxiliary anode having a through-opening for passage of said electron beam, and having a length along said propagation direction which is greater than or equal to a smallest clearance of said through-opening;

means for placing said electron emitter at an electron emitter potential relative to said anode; and means for placing said auxiliary anode at a positive potential relative to said electron emitter potential and including switch means operable with a pulse-pause ratio for producing a selected electron current between said electron emitter and said anode to place said auxiliary anode at said positive potential.

2. An electron emission system as claimed in claim 1 further comprising means for adjusting said pulse-pause ratio of said switching means.

3. An electron emission system as claimed in claim 1 wherein said means for placing said auxiliary anode at said positive potential comprises a voltage source connected to said switch means, and wherein said switch means comprises means for connecting said auxiliary anode to said voltage source with a succession of switching cycles, each switching cycle having a duration not significantly exceeding ten μs.

4. An electron emission system as claimed in claim 1 wherein said means for placing said auxiliary anode at said positive potential comprises means for placing said auxiliary anode at a positive potential having a magnitude in a range of from 5 through 20 kV.

5. An electron emission system as claimed in claim 1 further comprising an evacuated housing containing said electron emitter, said auxiliary anode and said anode, and wherein said anode comprises material which emits x-rays when struck by electrons from said electron emitter.

6. An electron emission system comprising:

an electron emitter which emits an electron beam in a propagation direction;

an anode;

a Wehnelt electrode disposed between said electron emitter and said anode, an auxiliary anode disposed between said Wehnelt electrode and said anode; said auxiliary anode having a through-opening for passage of said electron beam, and having a length along said propagation directions which is greater than or equal to a smallest clearance of said through-opening;

means for placing said electron emitter at an electron emitter potential relative to said anode; and means for placing each of said Wehnelt electrode and said auxiliary anode at respective potentials deviating from said electron emitter potential and including switch means operated with a pulse-pause ratio for setting a selected electron current between said electron emitter and said anode.

7. An electron emission system as claimed in claim 6 further comprising means for adjusting said pulse-pause ratio of said switching means.

8. An electron emission system as claimed in claim 7 wherein said means for placing each of said Wehnelt electrode and said auxiliary anode at respective potentials deviating from said electron emitter potential comprises means for connecting said Wehnelt electrode to a negative potential, relative to said electron emitter potential, via said switching means and means for connecting said auxiliary anode to a positive potential, relative to said electron emitter potential, via said switching means.

9. An electron emission system as claimed in claim 7 wherein said means for placing each of said Wehnelt electrode and said auxiliary anode at respective potentials deviating from said electron emitter potential comprises first and second voltage sources, and wherein said switching means comprises a first switch which connects said Wehnelt electrode to said first voltage source with a first switching cycle and a second switch which connects said auxiliary anode to said second voltage source with a second switching cycle, each of said first and second switching cycles not significantly exceeding ten microseconds.

10. An electron emission system as claimed in claim 7 wherein said means for placing each of said Wehnelt electrode and said auxiliary anode at respective potentials relative to said electron emitter potential comprises means for placing each of said Wehnelt electrode and said auxiliary anode at respective electrical potentials relative to said electron emitter potential each having an order of magnitude in a range of from 5 through 20 kV.

11. An electron emission system as claimed in claim 7 further comprising an evacuated housing containing said electron emitter, said Wehnelt electrode, said auxiliary anode and said anode, and wherein said anode comprises material which emits x-rays when struck by electrons from said electron emitter.

* * * * *